US007465895B2

(12) United States Patent
Yoshida

(10) Patent No.: US 7,465,895 B2
(45) Date of Patent: Dec. 16, 2008

(54) OPERATING SWITCH MECHANISM

(75) Inventor: Takashi Yoshida, Kadoma (JP)

(73) Assignee: Matsushita Electric Works, Ltd., Osaka (JP)

( * ) Notice: Subject to any disclaimer, the term of this patent is extended or adjusted under 35 U.S.C. 154(b) by 62 days.

(21) Appl. No.: 11/797,830

(22) Filed: May 8, 2007

(65) Prior Publication Data

US 2007/0261944 A1 Nov. 15, 2007

(30) Foreign Application Priority Data

May 12, 2006 (JP) ..... 2006-134286

(51) Int. Cl.
*H01H 9/18* (2006.01)

(52) U.S. Cl. ..... 200/310; 200/330; 200/331; 200/333; 200/329

(58) Field of Classification Search ..... 200/1 R, 200/5 R, 17 R, 18, 43.16, 43.18, 43.19, 43.22, 200/296, 297, 329, 330, 331, 332.1, 332.2, 200/333–335, 338; 361/601, 602, 627–629, 361/631, 633, 641, 643, 644, 647
See application file for complete search history.

(56) References Cited

U.S. PATENT DOCUMENTS 4,394,552 A * 7/1983 Schlosser ..... 200/61.62
5,193,667 A * 3/1993 Choi ..... 200/331
5,623,393 A * 4/1997 Yau ..... 361/682
5,794,759 A * 8/1998 Butts ..... 200/43.19
5,819,913 A * 10/1998 Reiter ..... 200/332
6,034,337 A * 3/2000 Siegert ..... 200/50.32
6,534,735 B1 * 3/2003 Czarnecki ..... 200/333
6,535,377 B2 * 3/2003 Carteau et al. ..... 361/632

FOREIGN PATENT DOCUMENTS

JP 2006-94452 A 4/2006

* cited by examiner

*Primary Examiner*—Michael A Friedhofer
(74) *Attorney, Agent, or Firm*—Sughrue Mion, PLLC

(57) ABSTRACT

Provided is an operating switch mechanism having a handle cover with enhanced rigidity. The operating switch mechanism has a chassis 1 in which individual switches 21 and a group switch are exposed from the front side. An indicator hole for passing light is formed in the chassis 1 to at locations facing light-emitting diodes indicating operation states of lighting apparatuses in association with the group switch. A handle body 4 is rotatably attached on the front side of the chassis 1 so as to press the group switch. An indicator hole is formed at the location corresponding to the indicator hole formed in the chassis 1. A handle cover 5 is rotatably attached on the front side of the handle body 4. An indicator hole is formed at the location corresponding to the indicator hole formed in the handle body 4. A concave groove 44 for attaching an indicator window 8 is formed on the front side. A protrusion 45 is formed on the rear side of the handle cover 5 so that a portion corresponding to the concave groove 44 protrudes towards the handle body 4.

5 Claims, 7 Drawing Sheets

(a)

(b)

OPERATING SWITCH MECHANISM

BACKGROUND OF THE INVENTION

1. Technical Field

The present invention relates to an operating switch mechanism used for controlling a load such as lighting apparatus.

2. Related Art

Conventionally, there has been provided an operating switch mechanism used for a remote monitoring control system in which loads such as lighting apparatuses are remotely monitored and controlled (for example, see Patent Document 1 described below). In the remote monitoring control system, a transmission unit, an operating switch mechanism for monitoring states of operating switches, and a control terminal for tuning on/off power of lighting apparatuses by using relays are connected via a double-wire signal line, and the transmission unit individually recognizes the operating switch mechanism and the control terminal by using individual addresses respectively set to the operating switch mechanism and the control terminal. Here, as the operating switch mechanism, some the operating switch mechanism monitor operation states of individual switches for individually turning on/off corresponding lighting apparatuses, and others monitor an operation state of a group switch for collectively turning on/off a plurality of lighting apparatuses as one group.

The operating switch mechanism used in the conventional remote monitoring control system is provided with either the individual switches for individually turning on/off corresponding lighting apparatuses or the group switch for collectively turning on/off a plurality of lighting apparatuses as one group. Therefore, in order to achieve both an individual control and a group control, both of the aforementioned two operating switch mechanisms are needed.

Accordingly, an operating switch mechanism including both the individual switches and the group switch has been proposed. This operating switch mechanism includes a chassis in which the individual switch and the group switch are exposed from the front side thereof. Inside the chassis is provided with individual indicator lamps and a group indicator lamp which respectively correspond to the individual switches and the group switch so as to indicate operation states of corresponding lighting apparatuses. Furthermore, indicator holes for passing light are formed on the front side of the chassis at locations corresponding to the individual indicator lamps and the group indicator lamp.

A handle body is rotatably attached to the front side of the chassis. An insertion holes for exposing manipulators of the individual switches are formed in the handle body at the locations corresponding to the individual switches. A protrusion is formed on the rear side of the handle body at the location corresponding to the group switch, so that a manipulator of the group switch is pressed by the protrusion when the handle body is pressed. In addition, indicator holes for transmission light are respectively formed in the handle body at the locations corresponding to the individual indicator lamp and the group indicator lamp.

A handle cover is rotatably attached on the front side of the handle body between an opening position for exposing the manipulators of the individual switches and a closing position for covering the manipulators of the individual switches. An indicator hole for passing light is formed in the handle cover at the location corresponding to the group indicator lamp. An attaching groove is formed on the front side of the handle cover at the location corresponding to the indicator hole. An indicator window having a light transmitting property is attached to the attaching groove in order to transmit light.

In the case of using the operating switch mechanism, if the handle cover is pressed in a state that the handle cover is closed (in a state that the handle cover is in the closing position), the handle body rotates along with the handle cover, and thus the protrusion formed on the rear side of the handle body presses the group switch. As a result, a plurality of lighting apparatuses belonging to one group is collectively turned on/off. On the other hand, the manipulators of the individual switches are exposed in a state that the handle cover is open (in a state that the handle cover is in the opening position). Therefore, if the manipulators of the individual switches are pressed in this state, lighting apparatuses in association with the pressed individual switch are individually turned on/off. In addition, if the handle body is pressed in this state, the group switch is pressed by the protrusion formed on the rear side of the handle body. As a result, the plurality of lighting apparatuses belonging to one group is collectively turned on/off.

[Patent Document 1] Japanese Unexamined Patent Application Publication No. 2006-94452 (pages 6 to 10, 12 to 15, FIGS. 1 to 6, and FIGS. 9 to 11)

In the latter case of the operating switch mechanism described above, the indicator hole is formed in the handle cover at the location corresponding to the group indicator lamp. Further, the attaching groove for attaching the indicator window having a light transmission property is formed on the front side of the handle cover at the location corresponding to the indicator hole. Since a portion having the attaching groove becomes as thin as the thickness of the attaching groove, there has been a problem in that the rigidity of the handle cover decreases.

SUMMARY OF THE INVENTION

The present invention has been made to solve the aforementioned problems, and an object of the present invention is to provide an operating switch mechanism which enhances the rigidity of a handle cover.

In order to achieve the aforementioned object, the invention of claim 1 provides a operating switch mechanism comprising: a chassis of which a front side is provided with first and second switches for respectively turning on/off corresponding loads and a first light indicator for indicating operation states of a load corresponding to the first switch; a handle body which has an insertion hole for exposing a manipulator of the second switch formed at the location corresponding to the second switch and is rotatably attached on the front side of the chassis so as to press the first switch towards the chassis accordance with the rotation thereof; and a handle cover which is rotatably attached on the front side of the handle body between an opening position for exposing the manipulator and a closing position for covering the manipulator, wherein first and second indicator holes for passing light are respectively formed in the handle cover and the handle body at the locations corresponding to the first light indicator, an attaching groove for attaching an indicator member having a light transmission property is formed on the front side of the handle cover at the location corresponding to the first indicator hole so as to transmit light emitted from the first light indicator, and the rear side of the attaching groove formed on the handle cover protrudes towards the handle body.

The invention of claim 2 provides the operating switch mechanism according to claim 1, wherein a pivot portion of the handle cover, which rotatably pivots towards the handle body, is thicker than other portions of the handle cover.

The invention of claim 3 provides the operating switch mechanism according to claim 1 or 2, wherein a trench in which a name card for indicating a load item in association with the first switch is formed on the surface of the handle body of the handle cover, a light transmitting portion is formed in a bottom of the trench so that the name card can be viewed from the front side, and a holding element for holding a name sheet in the handle body of the handle cover is formed in the handle cover in a state that the name card in the trench is held between the name sheet, which indicates a load item in association with the second switch, and the bottom of the trench.

The invention of claim 4 provides the operating switch mechanism according to any one of claims 1 to 3, wherein a second light indicator for indicating an operation state of a load in association with the second switch is formed on the front side of the chassis, a third indicator hole for passing light is formed in the handle body at the location corresponding to the second light indicator, and an optical spread member for spreading light is formed at the locations corresponding to the second and third indicator holes in a light transmitting direction with respect to the first and second light indicators.

DETAILED DESCRIPTION OF THE INVENTION

Hereinafter, exemplary embodiments of the present invention will be described with reference to FIGS. 1 to 8. An operating switch mechanism A according to the present invention is used for a remote monitoring control system in which loads (e.g., lighting apparatuses) are remotely monitored and controlled. In the following descriptions, unless defined otherwise, upper, lower, left, and right sides are defined with respect to a front side of the FIG. 6, where the front side corresponds to a front view of FIG. 6. Therefore, a rear side corresponds to a lower side of FIG. 1.

Figure 7:
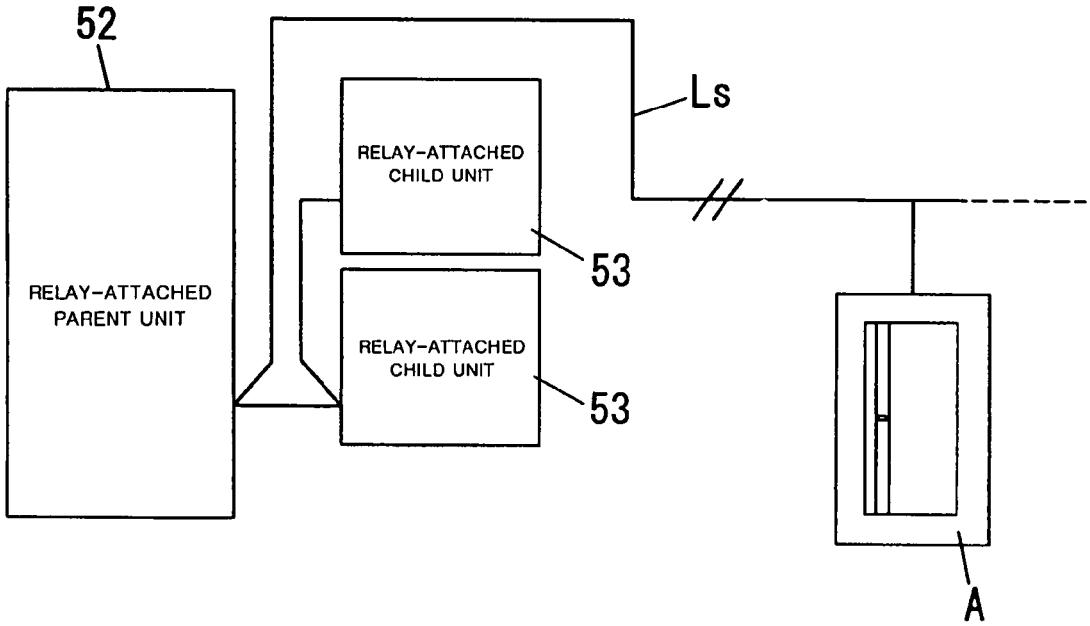
FIG. 7 is a schematic view illustrating a structure of a remote monitoring control system using the operating switch mechanism.

First, the remote monitoring control system will be described with reference to FIG. 7. FIG. 7 illustrates an overall configuration of the remote monitoring control system in which a relay-attached parent unit (hereinafter, referred to as a parent controller) 52, a plurality of relay-attached child units (hereinafter referred to as child controllers) 53, and an operating switch mechanism A are connected through a double-wire signal line Ls. Although one operating switch mechanism A and two child controllers 53 are shown in FIG. 7, the number of operating switch mechanism A and the number of child controllers 53 may vary depending on the number of loads to be controlled.

Figure 2:
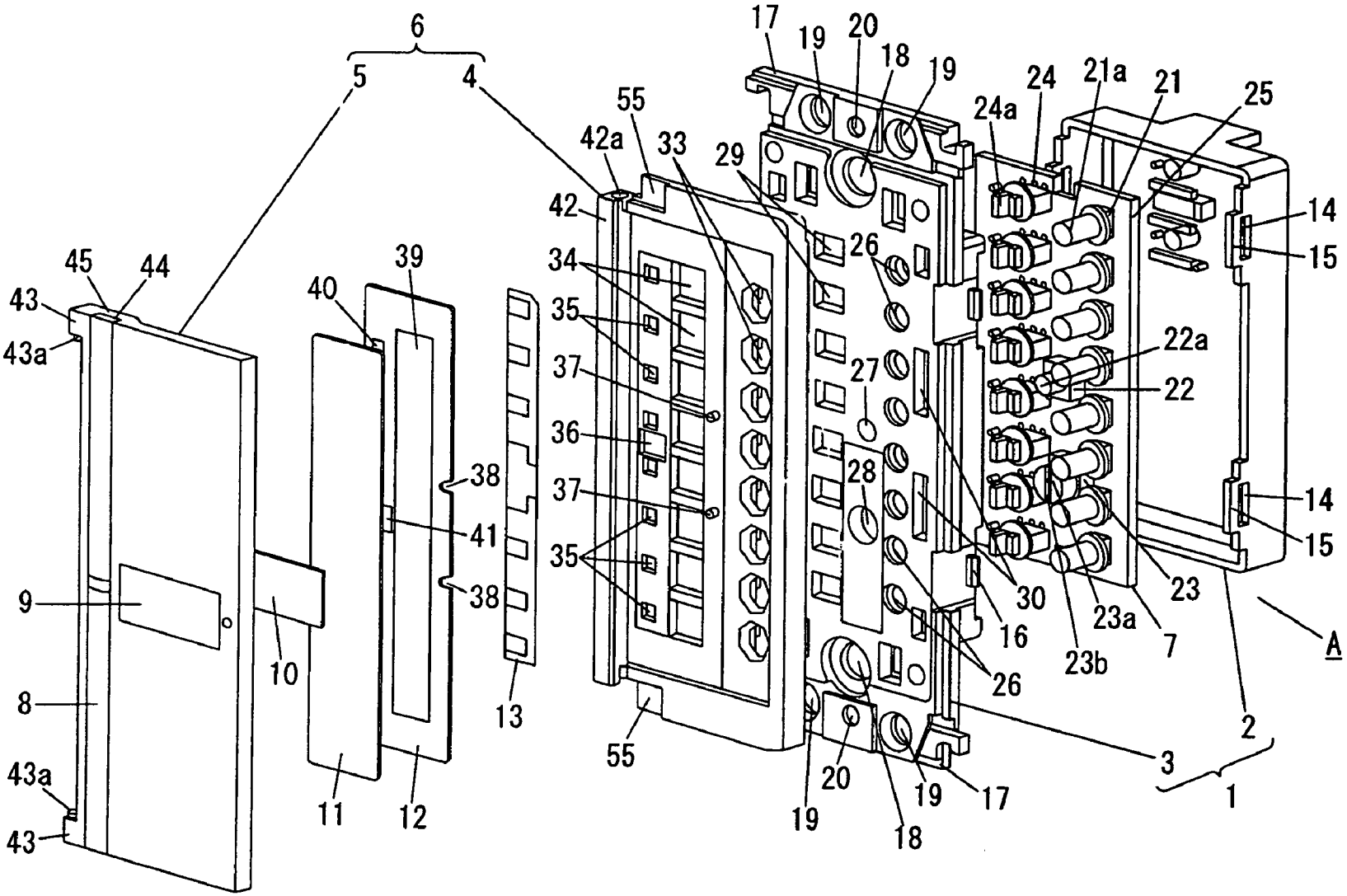
FIG. 2 is an exploded perspective view of the operating switch mechanisms.

The parent controller 52 and the child controllers 53 respectively include a plurality of relays (not shown) for turning on/off power supply to lighting apparatuses. Individual addresses are respectively set to the relays. The operating switch mechanism A, as shown in FIG. 2, includes an individual switch (a second switch) 21 for individually turning on/off the lighting apparatus and a group switch (a first switch) 22 for collectively turning on/off a plurality of lighting apparatuses as one group. Individual addresses are respectively set to the switches. The parent controller 52 uses these addresses in order to separately recognize the respective switches of the operating switch mechanism A and the relays provided in the parent controller 52 and the child controller 53.

Figure 8:
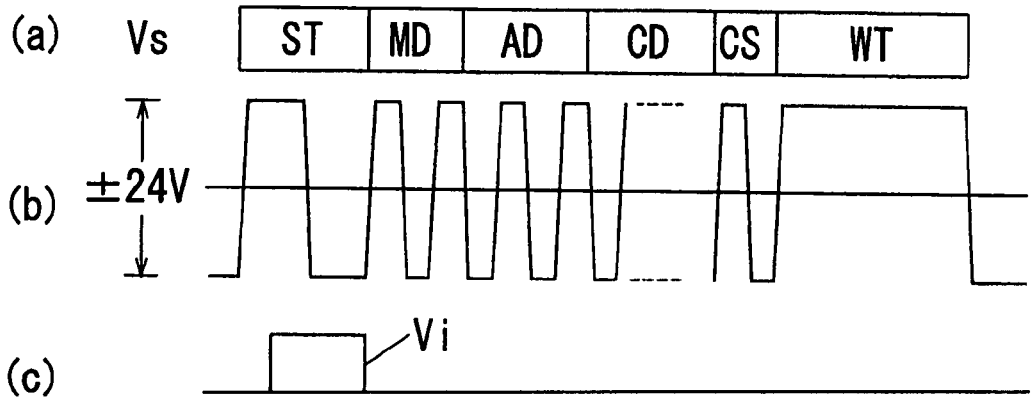
FIGS. 8(*a*) to 8(*c*) are explanatory views illustrating a transmission signal used in the remote monitoring control system.

The parent controller 52 functions as a transmission control device and transmits a transmission signal Vs having a format shown in FIG. 8(*a*) to the signal line Ls. Thus, data is transmitted/received between the child controller 53 and the operating switch mechanism A. The transmission signal Vs is a bipolar type (±24V) time division multiplexing signal containing a start pulse ST indicating the start of signal transmission, mode data MD indicating a signal mode, address data AD for separately identifying the parent controller 53 and the operating switch mechanism A, control data CD indicating a control item of a lighting apparatus, checksum data CS for detecting transmission errors, and a signal returning time period WT which is a time slot for receiving a returning signal from the child controller 53 and the operating switch mechanism A. Data transmission is carried out using a pulse width modulation (see FIG. 8(*b*)).

When the address data AD of the transmission signal Vs received through the signal line Ls coincides with a predetermined address, the child controller 53 and the operating switch mechanism A receives the control data CD from the transmission signal Vs as well as returns monitoring data of the respective switches and relays as a current mode signal (which is a signal transmitted by short-circuiting the signal line Ls through an appropriate low impedance element) during the signal returning time period WT of the transmission signal Vs. The parent controller 52 checks whether the control data CD is transmitted to the desired child controller 53 or the operating switch mechanism A in consideration of the relationship between the transmitted control data CD and the monitoring data received during the signal returning time period WT. In response to the received control data CD, the child controller 53 turns on/off a relay in association with the address data AD. In response to the received control data CD, the operating switch mechanism A outputs a signal for indicating an operation state of the relay.

In addition, the parent controller 52 ordinarily transmits the transmission signal Vs at a predetermined time interval (i.e., a round-the-clock polling) by setting the mode data MD to a dummy mode. When the operating switch mechanism A is to transmit certain information to the parent controller 52, an interrupt signal Vi shown in FIG. 8(*c*) is generated in synchronization with the start pulse signal ST of the transmission signal Vs set to a dummy mode. In this case, the operating switch mechanism A that has generated the interrupt signal Vi establishes an interrupt flag to prepare subsequent transmission/receipt of information to/from the parent controller 52. When the parent controller 52 receives the interrupt signal Vi, the mode data MD is set to an interrupt polling mode, and the transmission signal Vs is transmitted by incrementing successively an upper half bits of the address data AD. The operating switch mechanism A that has generated the interrupt signal Vi returns a lower half of bits of address during the signal returning time period WT when the upper half bits of the address data AD included in the transmission signal Vs transmitted on the interrupt polling mode, coincides with an upper half bits of address allocated to the a switch provided in the operating switch mechanism A.

When the parent controller 52 obtains the address (i.e., the address of the manipulated switch) of the operating switch mechanism A that has generated the interrupt signal Vi, the mode data MD is set to a monitoring mode, and the transmission signal Vs containing the obtained address data AD is transmitted to the signal line Ls. In addition, the operating switch mechanism A returns information to be transmitted within the signal returning time period WT in response to the transmission signal Vs. Thereafter, the parent controller 52 transmits a signal for instructing an interrupt reset operation to the operating switch mechanism A that has generated the interrupt signal Vi, and releases the interrupt flag of the operating switch mechanism A. As a result of the above process, information transmission from the operating switch mechanism A to the parent controller 52 is completed using 4 signal transmission chances (e.g., a dummy mode, an interrupt polling mode, a monitoring mode, and an interrupt reset) from the parent controller 52 to the operating switch mechanism A. Furthermore, the parent controller 52 can identify an operation condition of the desired child controller 53 just by transmitting the transmission signal Vs to the parent controller 52 by setting the mode data MD to the monitoring mode.

Hereinafter, the operating switch mechanism A of the present invention will be described with reference to FIG. 2. FIG. 2 is an exploded perspective view of the operating switch mechanism A. A chassis 1 of the operating switch mechanism A is formed by assembling a body 2 and a covering 3 made of a synthetic resin material. A handle body 4 is rotatably attached on the front side of the covering 3. A handle cover 5 is rotatably attached on the front side of the handle body 4. The chassis 1 has the same size as a sort of a fixed frame used for an implanted wiring device having a standard size, for example, defined in a Japanese Industrial Standards (JIS), etc and is implanted in a construction material with its front side being exposed.

Referring to FIG. 2, the body 2 has a substantial rectangular box shape elongated in a longitudinal direction and opened in its front side. A pair of engaging protrusions 15 is provided on each front edges of both left and right side walls and vertically separated from each other. The covering 3 has a substantial rectangular box shape in a longitudinal direction and opened its rear side. A pair of engaging prongs 16 is provided at each location corresponding to the pair of engaging protrusions 15. The pair of engaging prongs 16 is engaged with engaging holes 14 formed at the pair of engaging protrusions 15, thereby joining the covering 3 and the body 2.

Furthermore, fastening pieces 17 and 17 are respectively vertically extended from the front edges of both upper and lower side walls of the covering 3. Each fastening piece 17 includes: a long hole 18 for inserting a screw fastened to an implanting box; an insertion hole 19 for inserting a fastening screw in order to directly attach the chassis 1 to the construction material; and a screw hole 20 for tightening the fastening screw in order to attach a decoration plate (not shown), where the decoration plate has an opening to expose the handle cover 5 and the handle body 4.

The chassis 1 contains eight individual switches 21 each composed of a tact switch, a group switch 22 composed of a tact switch, light-emitting diodes 31 (see FIG. 1) each of which indicates an operation state of a lighting apparatus in association with each individual switch 21, a light-emitting diode (not shown) which indicates an operation state of a lighting apparatus in association with the group switch 22, an address setting switch 23 composed of a rotary switch, eight group setting switches 24 each of which is composed of a slide switch to determine whether or not each individual switch 21 will be set to a group, a print board unit 7 having a print board 25 mounted at least with the aforementioned switches and light-emitting diodes. The individual switches 21 are vertically aligned in the right side of the print board 25. The light-emitting diodes 31 in association with the individual switches 21 are disposed to have the almost same height as the corresponding individual switches 21 on the left side of the print board 25. The group switch 22 is disposed left to the individual switches 21 near the vertical center of the print board 25. The light-emitting diode in association with the group switch 22 is disposed on the left side of the print board 25 to have the almost same height as the group switch 22. The address setting switch 23 is disposed below the group switch 22. The group setting switches 24 are vertically aligned left to the group switch 22 to have the almost same heights as corresponding individual switches 21. The rear side of the body 2 is provided with a screw terminal (not shown) connecting the signal line Ls. The print board unit 7 and the signal line Ls are electrically connected through the screw terminal.

Corresponding to the locations of the individual switch 21 and the group switch 22, the front side of the covering 3 is provided with insertion holes 26 for respectively inserting pressing buttons 21*a* (manipulators for the second switches) attached to the individual switch 21 in a back-and-forth movable manner and an insertion hole 27 for inserting a pressing button 22*a* attached to the group switch 22 in a back-and-fourth movable manner. Indicator holes 32 (see FIG. 1) for passing light are formed to face the light-emitting diodes 31. An indicator hole (not shown) for transmitting light is formed to face the light-emitting diode in association with the group switch 22. Corresponding to the location of the address setting switch 23, an insertion hole 28 for inserting a manipulator 23*a* of the address setting switch 23 is formed. Corresponding to the location of each group setting switch 24, an insertion hole 29 for inserting a handle 24*a* of the group setting switch 24 in a horizontally movable manner is formed. The manipulator 23*a* of the address setting switch 23 is provided with a groove 23*b* so as to be able to turn by a tool such as a screwdriver.

Figure 6:
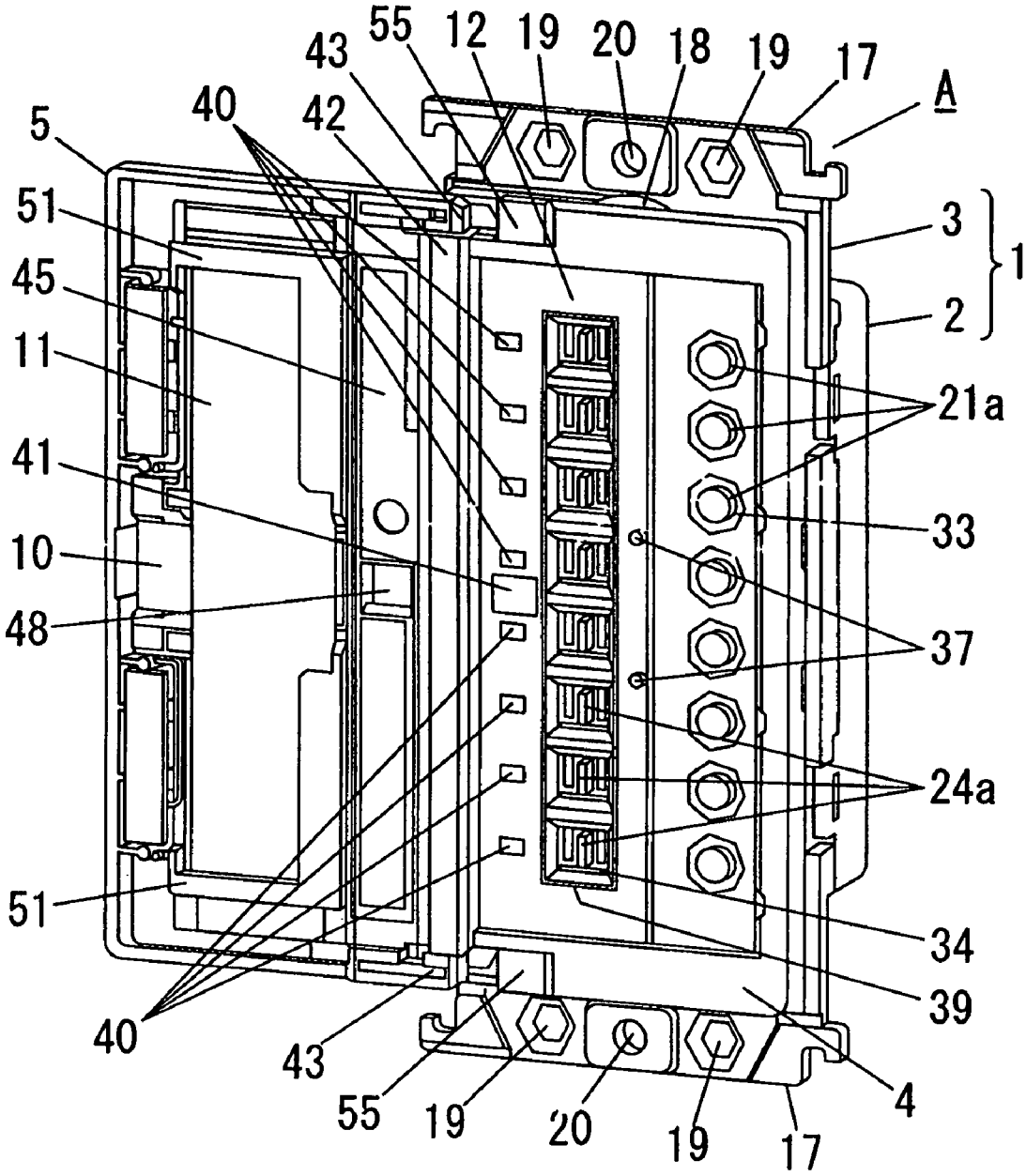
FIG. 6 is a perspective view of the operating switch mechanism when the handle cover is open.

Referring to FIG. 6, the handle body 4 which is made of a synthetic resin material is rotatably attached on the front side of the covering 3 in order to press the group switch 22. The handle body 4, as shown in FIG. 2, has a rectangular plate shape elongated in a longitudinal direction. A pair of bearings (not shown) having a spring or the like are disposed on the rear side of the handle body 4 on the right side when viewed in a widthwise direction. On the front side of the covering 3, a pair of axes (not shown) is integrally formed at the location corresponding to the bearings of the handle body 4. When the axis of the covering 3 is inserted into the bearings of the handle body 4, the handle body 4 rotatably pivots towards the covering 3 on the left side when viewed from the front side. A pair of engagement release protection pieces 47 (see FIG. 4) protrudes backwardly on the left side of the rear side of the handle body 4. Each engagement release protection piece 47 is inserted into the engagement hole 30 formed in the covering 3, and thus the front end of the engagement release protection piece 47 is engaged with a terminal edge of the engagement hole 30. As a result, a rotation range of the handle body 4 is limited.

Figure 4:
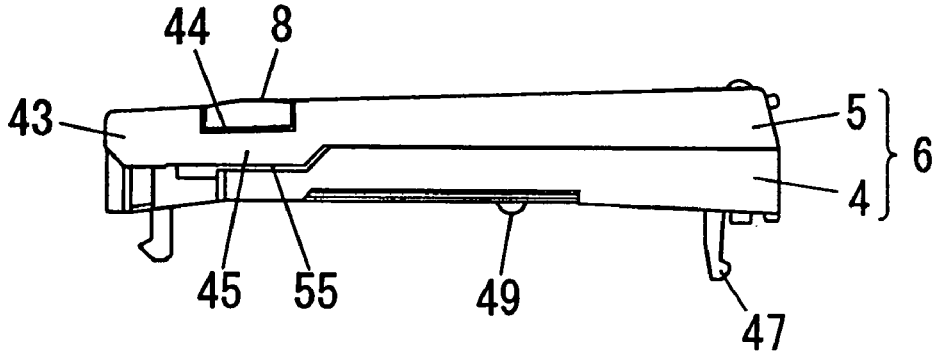
FIG. 4(*a*) is a plan view of a handle unit of the operating switch mechanism when a handle cover is closed, and FIG. 4(*b*) is a plan view of a handle unit of the operating switch mechanism when a handle cover is open.
Figure 4:
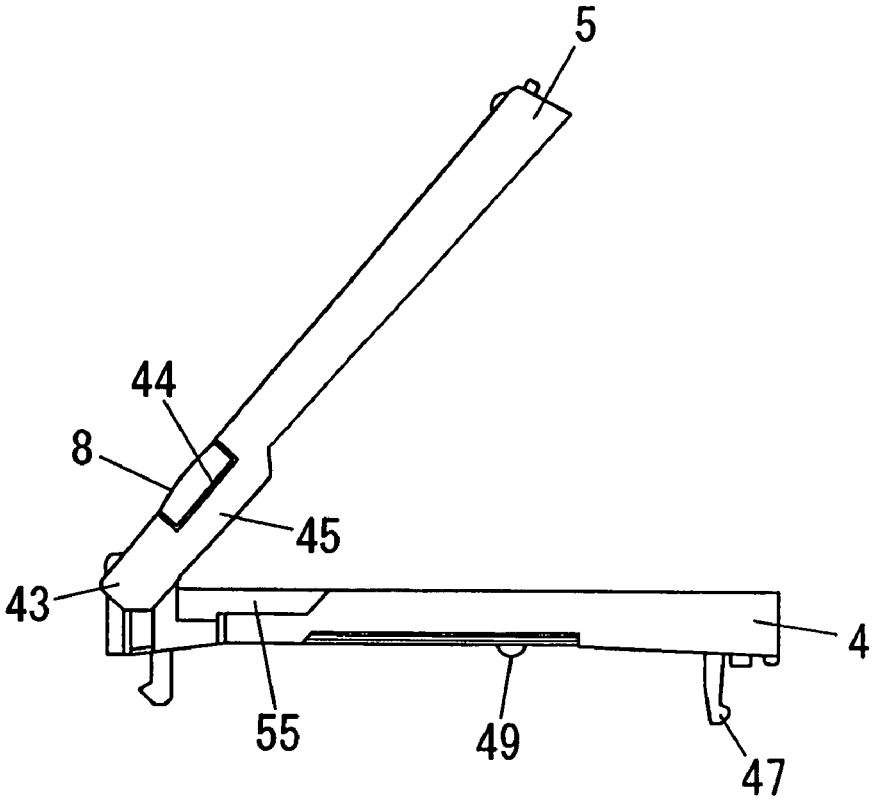

Corresponding to the location of the press button 22*a* of the group switch 22, the rear side of the handle body 4 is provided with a projection 49 (see FIG. 4). Upon pressing the right side of the handle body 4, the press button 22*a* of the group switch 22 is pressed by the projection 49 formed on the rear side thereof, thereby turning on the group switch 22. On the other hand, when the strength exerted on the handle body 4 is released, the handle body 4 is restored to its original position due to a repulsive force of a spring of the bearing etc, thereby turning off the group switch 22.

Corresponding to the location of each individual switch 21, an insertion hole 33 is formed in the handle body 4 so as to insert the press button 21*a* of the individual switch 21 in a back-and-fourth movable manner, with the press button 21*a* of the individual switch 21 being exposed. Corresponding to the location of the group setting switch 24, an insertion hole 34 is formed to insert the handle 24*a* of the group setting switch 24 in a left-and-right movable manner. Corresponding to the location of each light-emitting diode 31, the indicator hole 35 for passing light is formed. The indicator hole 36 for passing light is formed to face the light-emitting diode in association with the group switch 22. An optical spread sheet 13 having a rectangular plate shape elongated in a longitudinal direction is attached to the front side of the handle body 4 at the locations corresponding to the indicator holes 35 and 36 so as to spread light. The front side of the optical spread sheet 13 indicating how to control the group setting switch 24 is attached with a name plate 12 having a rectangular shape. Corresponding to the locations of the group setting switch 24 and the indicator holes 35 and 36, notches 39, 40, 41 are formed in the name plate 12. Corresponding to the location of a pair of bosses 37 which is formed on the front side of the handle body 4 so as to determine locations, a pair of notches 38 each having a half-moon shape are formed in the name plate 12. The name plate 12 is attached to the handle body 4 with the bosses 37 being inserted into the notches 38.

The handle cover 5 which is made of a synthetic resin material is attached on the front side of the handle body 4 so as to openably cover the press button 21*a* of the individual switch 21 and the handle 24*a* of the group setting switch 24. The handle cover 5, as shown in FIG. 2, has a rectangular shape elongated in a longitudinal direction. Arms 43 and 43 protrude from the both upper and lower end portions in a lateral direction on the left side of the handle cover 5. The both arms 43 and 43, as shown in FIG. 4, are thicker in a back-and-forth direction than other portions of the handle cover 5. An axis 43*a* protrudes from each arm 43 towards its opposite arm 43. A protrusion base 42 forwardly protruding is formed on the left side of the handle body 4. An axis hole 42*a* is formed in each of the upper and lower edges of the protrusion base 42. By pivoting the axis 43*a* of each arm 43 towards the axis hole 42*a*, the handle cover 5 is rotatably attached to the front side of the handle body 4 between an opening position (see FIG. 6) for exposing the press buttons 21*a* of the individual switches and 21 and the handle 24*a* of the group setting switch 24 and a closing position (see FIG. 1) for covering the press buttons 21*a* of the individual switches 21 and the handle 24*a* of the group setting switch 24.

Figure 5:
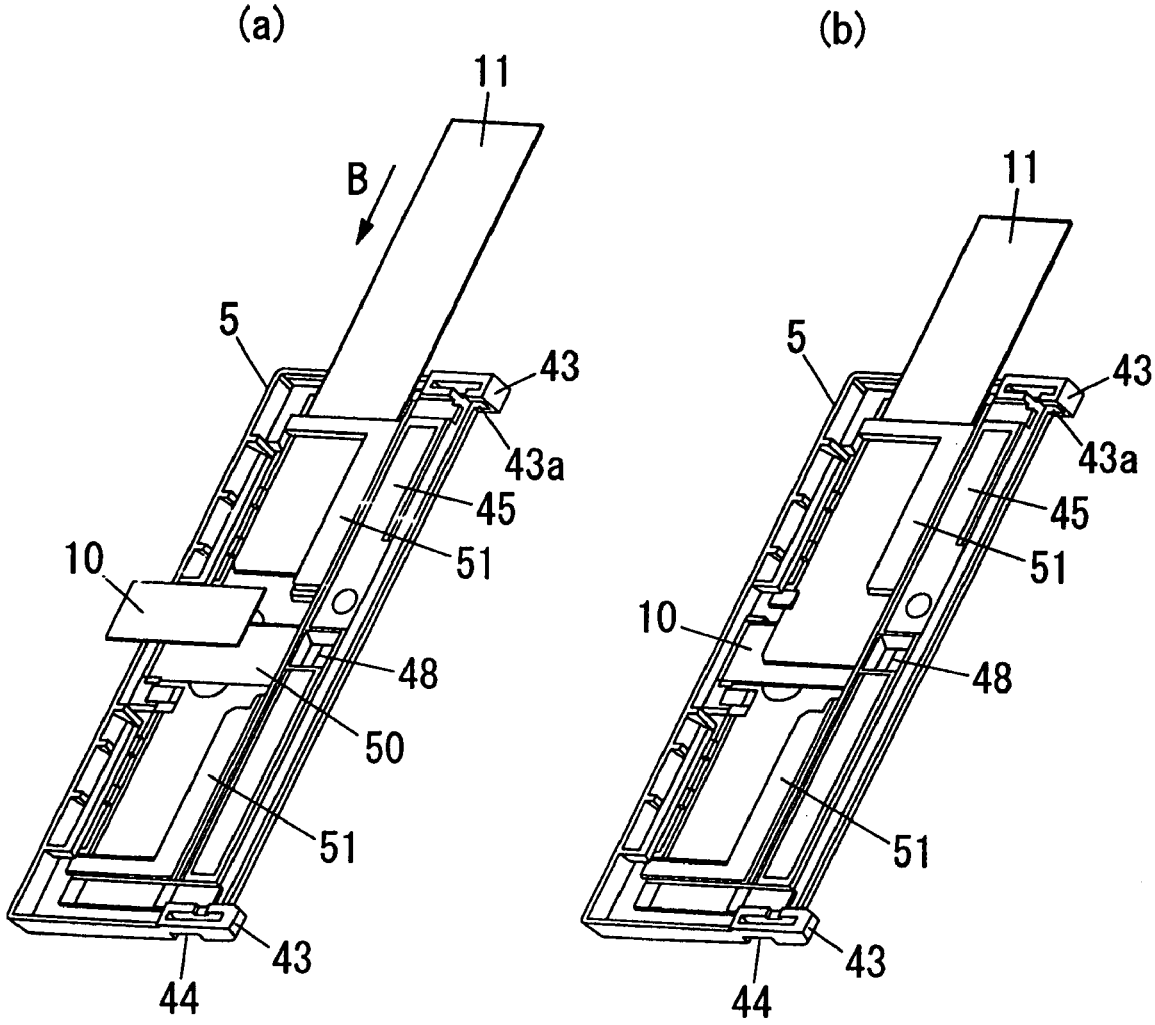
FIGS. 5(*a*) and 5(*b*) are explanatory views illustrating the handle cover of the operating switch mechanism attached with a name sheet and a name card.

A card trench 50 for holding the name card 10, as shown in FIG. 5, is formed on the rear side of the handle cover 5. A name cover 9 (see FIG. 2) having a light transmission property is formed as the bottom of the card trench 50 so that the name card 10 can be viewed from the front side. A pair of sheet holding pieces 51 and 51 having a substantial L-shape is formed on the rear side of the handle cover 5, almost parallel to the rear side thereof. Also, a trench groove 54 (see FIG. 1) is formed between the rear side of the handle cover 5 and the sheet holding pieces 51 and 51 so that the name sheet 11 is inserted thereto. The sheet holding pieces 51 and 51 are apart each other across the card trench 50 being disposed therebetween in a longitudinal direction of the handle cover 6. The sheet holding piece 51 disposed below the card trench 50 has a closed lower end. The sheet holding piece 51 disposed above the card trench 50 has an open upper end in order to insert the name sheet 11 from the upper side. Here, in a state that the name card 10 is held in the card trench 50, as shown in FIG. 5(*a*), if the name sheet 11 is inserted into the trench groove 54 from the upper side (direction B), the name sheet 11 is held between the sheet holding pieces 51 and 51 while the name card 10 is held between the name cover 9 and the name sheet 11. At this time, the name sheet 11 comes in contact with the lower side and the right side of the sheet holding piece 51 disposed in the lower side of the card trench 50 and also comes in contact with the upper side and the right side of the sheet holding piece 51 disposed in the upper side thereof. In addition, the indication (of an element to be controlled in association with the group switch 22) of the name card 10 can be viewed from the front side. Also, the indication (of an elements to be controlled in association with the individual switches 21) of the name sheet 11 can be viewed from the rear side.

Figure 1:
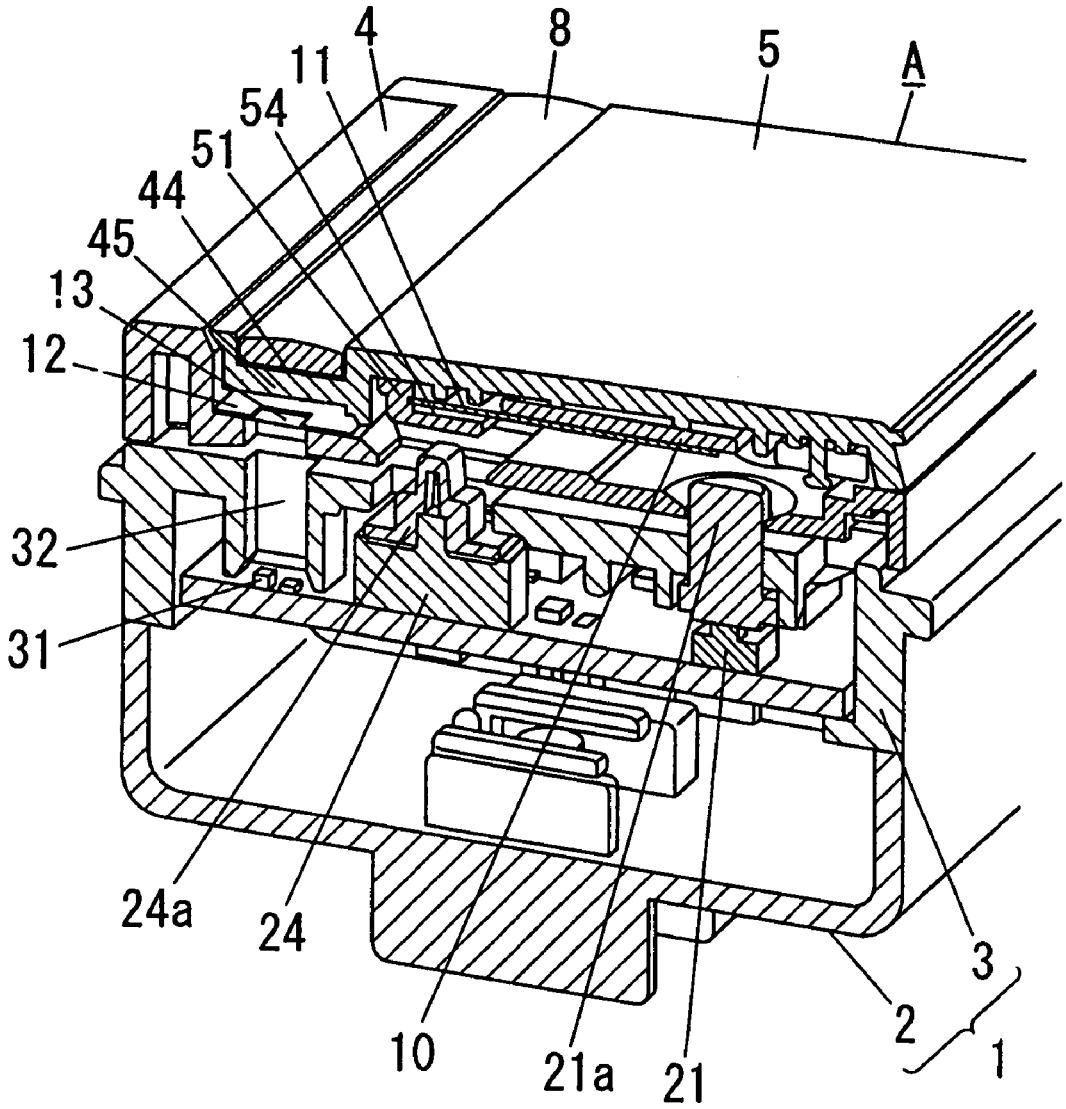
FIG. 1 is a cross-sectional view of an operating switch mechanism according to an embodiment of the present invention.
Figure 3:
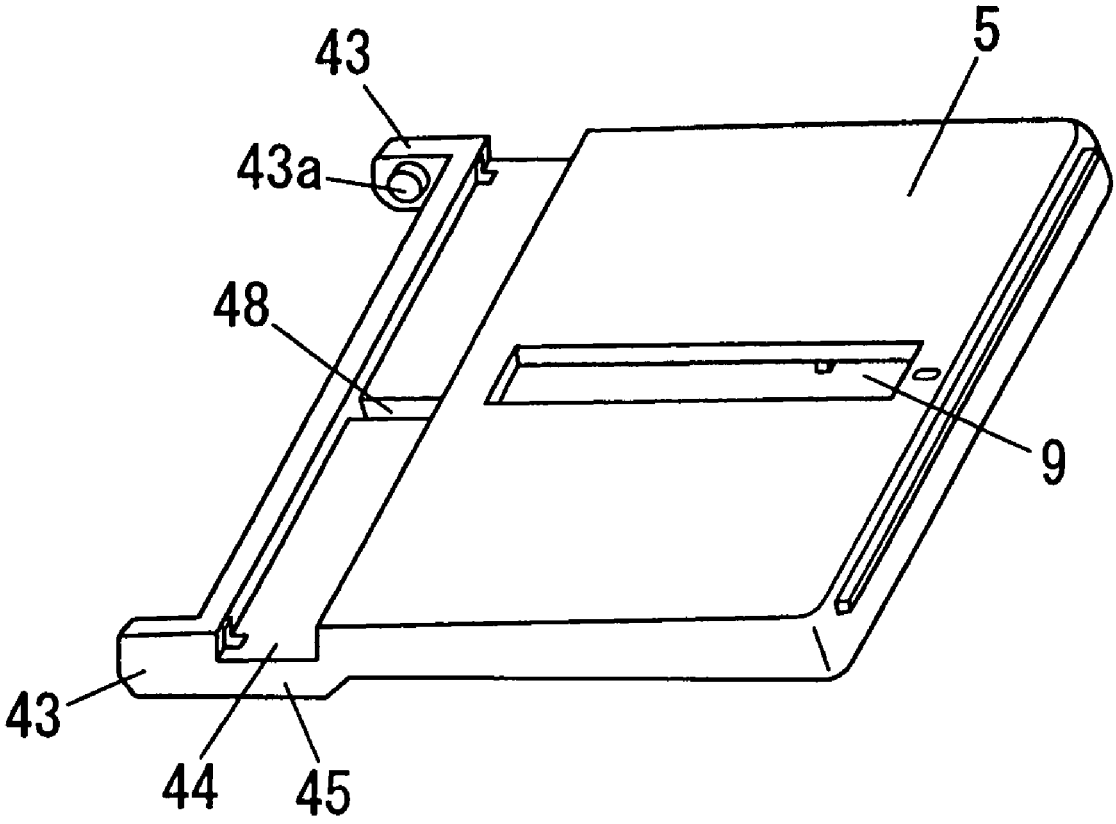
FIG. 3 is a perspective view of the operating switch mechanism.

Corresponding to the location of the indicator hole 36 formed in the handle body 4, an indicator hole 48 for passing light, as shown in FIG. 3, is formed on the left side of the front side of the handle cover 5. A concave groove (an attaching groove) 44 is vertically elongated on the front side of the handle cover 5, across the location of the indicator hole 48. An indicator window (an indicator member) 8 having a band plate shape with a light transmission property, as shown in FIGS. 1 and 2, is attached to the concave groove 44. Light emitted from the light-emitting diode in association with the group switch 22 transmits through the indicator hole 48 and the indicator window 8 so that an indicated item can be viewed from outside. As shown in FIGS. 1, 3, and 4, corresponding to the location of the concave groove 44, a protrusion 45 protruding towards the handle body 4 is formed on the rear side of the handle cover 5. In addition, a trench 55, as shown in FIG. 4(*a*), is formed on the left side of the handle body 4 in the both upper and lower ends thereof so that the protrusion 45 disposed in the handle cover 5 is held therein when the handle cover 5 is closed.

Now, an assembly procedure of the operating switch mechanism A will be described. First, the print board unit 7 is placed inside the body 2, and then the front side of the body 2 is covered with the covering 3. The engagement protrusion 16 is engaged with the engagement hole 14 of the engagement protrusion piece 15. Thus, the body 2 is joined with the covering 3, and then the assembly of the chassis 1 is completed. In this case, the individual switch 21, the group switch 22, and the group setting switch 24 which are disposed on the print board 25 are respectively provided with the press button 21*a*, the press button 22*a*, and the handle 24*a*. The press button 21*a*, the press button 22*a*, and the handle 24*a* are forwardly exposed through the insertion holes 26, 27, and 29 formed in the covering 3. In addition, the manipulator 23*a* of the address setting switch 23 is also forwardly exposed through the insertion hole 28 formed in the covering 3.

Next, an assembly procedure of the handle unit 6 will be described. First, the name sheet 11 is inserted into the trench groove 54 in a state that the name card 10 is placed in the trench 50 formed on the rear side of the handle cover 5. The name sheet 11 has to be held between the pair of sheet holding pieces 51 while the name card 10 has to be held between the name cover 9 and the name sheet 11. The indicator window 8 is formed in the concave groove 44 on the front side of the handle cover 5. Corresponding to the locations of the indicator holes 35 and 36, the optical spread sheet 13 is attached to the front side of the handle body 4. The name plate 12 is attached to the handle body 4 in a state that the protrusion 37, which is formed on the front side of the handle body 4 so as to determine locations, is inserted into the notch 38 of the name plate 12 from the front side thereof. The axis 43*a* formed in the arms 43 and 43 of the handle cover 5 pivots towards the axis hole 42*a* formed in the protrusion base 42 of the handle body 4, and thus the handle cover 5 is rotatably attached on the front side of the handle body 4, thereby completing the assembly of the handle unit 6.

In addition, the front side of the chassis 1 is covered with the handle unit 6, and the axis formed on the front side of the chassis 1 is inserted into the bearing disposed on the rear side of the handle body 4. Thus, the handle unit 6 is rotatably attached to the chassis 1, thereby completing the assembly of the operating switch mechanism A as shown in FIG. 6.

Next, an address setting procedure for the operating switch mechanism A will be described. First, with the handle unit 6 open from the covering 3 of the chassis 1, by rotating the manipulator 23*a* of the address setting switch 23 which is exposed through the insertion hole 28 formed in the covering 3, an address of each individual switch 21 is set to a desired address.

Next, a group setting procedure for the operating switch mechanism A will be described. First, as shown in FIG. 6, with the handle cover 5 open until the front side of the handle body 4 is exposed, by sliding each handle 24*a* of the group setting switch 24 which is exposed through the insertion hole 34 formed in the handle body 4 either to the left or to the right, lighting apparatuses are set to a group so as to be collectively turned on/off.

Next, a procedure of using the operating switch mechanism A will be described. First, a procedure of turning on/off lighting apparatuses set to a group will be described. Referring to FIG. 1, when the right side of the front side of the handle cover 5 is pressed in a state that the handle cover 5 is closed, the handle body 4 rotates along with the handle cover 5. As a result, the protrusion 49 formed on the rear side of the handle body 4 presses the press button 22*a* of the group switch 22, thereby turning on the group switch 22. When the group switch 22 is turned on, a transmission signal is transmitted or received according to the aforementioned transmission procedure. Thus, a corresponding lighting apparatus is turned on or off while the light-emitting diode in association with the group switch 22 is turned on or off. In this case, light emitted from the light-emitting diode is spread to the optical spread sheet 13 and thereafter transmits through the indicator window 8 for external emission. Therefore, it is possible to check the operation state of the lighting apparatus according to the light emitted from the light-emitting diode. In addition, when the strength exerted on the handle cover 5 to press it is released, the handle cover 5 and the handle body 4 are restored to their original positions due to a repulsive force of, for example, a spring of the bearings formed on the rear side of the handle body 4, as a result, the group switch 22 is turn off.

Next, a procedure of turning on/off lighting apparatuses in association with the individual switch 21 will be described. Referring first to FIG. 6, in a state that the handle cover 5 is open until the front side of the handle body 4 is exposed, upon pressing the press button 21*a* of the individual switch 21 in association with the lighting apparatus to be on/off from this state, the individual switch 21 is turned on. When the individual switch 21 is turned on, the transmission signal is transmitted or received according to the aforementioned procedure. Thus, a corresponding lighting apparatus is turned on or off while the light-emitting diode 31 in association with the individual switch 21 pressed is turned on or off. In this case, light emitted from the light-emitting diode 31 passing through the indicator hole 35 formed in the handle body 4, and is spread to the optical spread sheet 13 for external emission. Therefore, it is possible to check the operation state of the lighting apparatus according to the light emitted from the light-emitting diode 31. In addition, in this case, since the group switch 22 may be pressed by pressing the right side of the front side of the handle body 4, the lighting apparatus in association with the group switch 22 can be turned on/off.

In the aforementioned operating switch mechanism A, although the concave groove 44 is formed on the left side of the front side of the handle cover 5 so as to attach the indicator widow 8, since the protrusion 45 protruding towards the handle body 4 is formed on the rear side of the handle cover 5 at the location corresponding to the concave groove 44, the handle cover 5 may be reinforced when it is thickened by the protrusion 45. Accordingly, even when the handle cover 5 is open by more than a possible opening and closing angle, a portion having the concave groove 44 may maintain its rigidity, and thus the handle cover 5 may be protected against damage. Furthermore, each arm 43 may be reinforced by further thickening the both arms 43 and 43 formed in the handle cover 5 in a back-and-front direction than other portions of the handle cover 5. As a result, the handle cover 5 is protected against damage, and the handle cover 5 can be firmly attached to the handle body 4 without staggering. In addition, since the handle cover 5 may be separated from the pivot portion of the handle body 4 in the case of an abrupt operation, the handle cover 5 can be protected against damage.

Since the name sheet 11 is inserted into the trench groove 54 formed on the rear side of the handle cover 5 and is held between the sheet holding pieces 51 and 51 while the name card 10 is held between the named sheet 11 and the name cover 9, a mechanism or an element dedicated to hold the name card 10 is not necessary. Therefore, the handle cover 5 can be constructed with a simple structure and a small number of elements. In addition, the handle cover 5 can be thinned because an extra area for the dedicated mechanism or the element is not required.

Since the optical spread sheet 13 for spreading light is formed on the front side of the handle body 4 at the locations corresponding to the indicator holes 35 and 36, and light emitted from the light-emitting diode 31 and the light-emitting diode in association with the group switch 22 is spread to the optical spread sheet 13 so as to be uniformly emitted from a surface of the optical spread sheet 13, it is possible to obtain light with spotless brightness. In the conventional case, since light with spotty brightness is emitted from the light-emitting diode, when a portion having high brightness decreases its brightness, a portion having low brightness further decreases its brightness as a result. In addition, when a portion having low brightness increases its brightness, a portion having high brightness further increases its brightness. Therefore, it was difficult to obtain optimal brightness. However, by the use of the optical spread sheet 13, the light emitted from the light-emitting diode is uniformly emitted from a surface of the optical spread sheet 13, thereby facilitating the optimization of brightness. Further, power optimization may be also achieved. In addition, in the conventional case, even when the handle cover 5 is closed (see FIG. 1), light emitted from a portion having high brightness may transmit through the handle cover 5, which may lead to optical leakage. However, by the use of the optical spread sheet 13, the light emitted from the portion having high brightness can be smoothed and decreased, thereby avoiding optical leakage.

Although the individual switch 21 and the group switch 22 are described in the present embodiment as an example, the switch used is not limited thereto. Thus, any switch may be used as long as it can be pressed from the rear side of the handle body 4 and can be directly pressed with being exposed from the front side of the handle body 4. In addition, although the light-emitting diode is exemplified in the present embodiment as a light source that indicates an operation state of loads in association with the individual switch 21 and the group switch 22, the light source used is not limited thereto. Thus, any light source may be used as long as an indicated item can be viewed.

In addition, although the optical spread sheet 13 is formed, as an optical spread member in the present embodiment, on the front side of the handle body 4 at the location corresponding to the indicator holes 35 and 36, the optical spread member is not limited to the optical spread sheet 13. Thus, the optical spread member may be formed by inserting a resin material having an optical spread property into the indicator holes 35 and 36. Further, the optical spread sheet 13 is not necessarily placed in the positions of the present embodiment as long as it is placed in a transmitting direction with respect to the light-emitting diode at the locations corresponding to the indicator holes 35 and 36. Furthermore, although the operating switch mechanism A is used as a remote monitoring control system for remotely monitoring and controlling a lighting apparatus in the present embodiment, the usage of the operating switch mechanism A is not limited thereto as long as it can be used for controlling a load, for example, for directly turning on/off power supply to the load.

According to the invention of claim 1, a portion having an attaching groove can be reinforced when it is thickened by protruding a portion of the rear side of the attaching groove formed in a handle cover towards a handle body. Therefore, even when the handle cover is open by more than a possible opening and closing angle, a portion having the attaching groove may maintain its rigidity, and thus the handle cover may be protected against damage.

According to the invention of claim 2, a pivot portion of the handle cover can be reinforced by thickening it than other portions of the handle cover. Therefore, the handle cover itself is protected against damage, and the handle cover can be firmly attached to the handle body without staggering. In addition, since the handle cover may be separated from the pivot portion of the handle body in the case of an abrupt operation, the handle cover can be protected against damage.

According to the invention of claim 3, since the name sheet is held between a name sheet and a base of a trench, a mechanism or an element dedicated to hold the name card is not necessary. Therefore, the handle cover can be constructed with a simple structure and a small number of elements. In addition, the handle cover can be thinned because an extra area for the dedicated mechanism or the element is not required.

According to the invention of claim 4, an optical spread member for spreading light is formed at the locations corresponding to the second and third indicator holes in a light transmitting direction with respect to the first and second light indicators, and light emitted from the first and second light indicators is spread to the optical member so as to be uniformly emitted from a surface of the optical spread member. Therefore, it is possible to obtain light with spotless brightness. In the conventional case, since the emitted light has spotty brightness, when a portion having high brightness decreases its brightness, a portion having low brightness further decreases its brightness as a result. In addition, when a portion having low brightness increases its brightness, a portion having high brightness further increases its brightness. Therefore, it was difficult to obtain optimal brightness. However, by the use of the optical spread member, the light is uniformly emitted from a surface of the optical spread member, thereby facilitating the optimization of brightness. Further, power optimization may be also achieved. In addition, in the conventional case, even when the handle cover is closed, light emitted from a portion having high brightness may transmit through the handle cover, which may lead to optical leakage. However, by the use of the optical spread member, the light emitted from the portion having high brightness can be smoothed and decreased, thereby avoiding optical leakage.

What is claimed is:

1. A operating switch mechanism comprising:

a chassis of which a front side is provided with first and second switches for respectively turning on/off corresponding loads and a first light indicator for indicating an operation state of a load corresponding to the first switch;

a handle body which has an insertion hole for exposing a manipulator of the second switch formed at a location corresponding to the second switch and is rotatably attached on a front side of the chassis in so as to press the first switch towards the chassis accordance with the rotation thereof, and a handle cover which is rotatably attached on a front side of the handle body between an opening position for exposing the manipulator and a closing position for covering the manipulator, wherein first and second indicator holes for passing light are respectively formed in the handle cover and the handle body at the locations corresponding to the first light indicator, an attaching groove for attaching an indicator member having a light transmission property is formed on the front side of the handle cover at the location corresponding to the first indicator hole so as to transmit light emitted from the first light indicator, and a rear side of the attaching groove formed on the handle cover protrudes towards the handle body.

2. The operating switch mechanism according to claim 1, wherein a pivot portion of the handle cover, which rotatably pivots towards the handle body, is thicker than other portions of the handle cover.

3. The operating switch mechanism according to claim 1 or 2, wherein a trench in which a name card for indicating a load item in association with the first switch is formed on the surface of the handle body of the handle cover, a light transmitting portion is formed in a bottom of the trench so that the name card can be viewed from the front side, and a holding element for holding a name sheet in the handle body of the handle cover is formed in the handle cover in a state that the name card in the trench is held between the name sheet, which indicates a load item in association with the second switch, and the bottom of the trench.

4. The operating switch mechanism according to claim 1 or 2, wherein a second light indicator for indicating an operation state of a load in association with the second switch is formed on the front side of the chassis, a third indicator hole for passing light is formed in the handle body at the location corresponding to the second light indicator, and an optical spread member for spreading light is formed at the locations corresponding to the second and third indicator holes in a light transmitting direction with respect to the first and second light indicators.

5. The operating switch mechanism according to claim 3, wherein a second light indicator for indicating an operation state of a load in association with the second switch is formed on the front side of the chassis, a third indicator hole for passing light is formed in the handle body at the location corresponding to the second light indicator, and an optical spread member for spreading light is formed at the locations corresponding to the second and third indicator holes in a light transmitting direction with respect to the first and second light indicators.

* * * * *